US008382198B2

(12) United States Patent
Maeba et al.

(10) Patent No.: US 8,382,198 B2
(45) Date of Patent: Feb. 26, 2013

(54) DEVICE REMOVING/RE-INSERTING STRUCTURE, AND DEVICE REMOVING/RE-INSERTING METHOD FOR CONSTRUCTION MACHINE

(75) Inventors: Eiji Maeba, Hiroshima (JP); Shuhei Kaiso, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 0 days.

(21) Appl. No.: 13/216,526

(22) Filed: Aug. 24, 2011

(65) Prior Publication Data

US 2012/0061995 A1 Mar. 15, 2012

(30) Foreign Application Priority Data

Sep. 14, 2010 (JP) ..... 2010-205689

(51) Int. Cl.
*B62D 25/24* (2006.01)

(52) U.S. Cl. ..... 296/203.01

(58) Field of Classification Search ..... 296/193.06, 296/193.07, 203.01, 204; 37/347
See application file for complete search history.

(56) References Cited

U.S. PATENT DOCUMENTS

| | | | | |
|---|---|---|---|---|
| 2003/0150138 | A1 | 8/2003 | Akahane et al. | |
| 2004/0181977 | A1 | 9/2004 | Yamamoto et al. | |
| 2008/0211265 | A1 * | 9/2008 | Rochester et al. | 296/204 |
| 2008/0231085 | A1 * | 9/2008 | Westing et al. | 296/204 |
| 2009/0084003 | A1 * | 4/2009 | Nobayashi et al. | 37/347 |

FOREIGN PATENT DOCUMENTS

| | | | |
|---|---|---|---|
| JP | 11081374 | A * | 3/1999 |
| JP | 2004-276846 | | 10/2004 |
| JP | 2004-324229 | | 11/2004 |
| JP | 2006-298355 | | 11/2006 |
| JP | 2006322133 | A * | 11/2006 |
| JP | 2008-75372 | | 4/2008 |
| JP | 2008-240676 | | 10/2008 |

OTHER PUBLICATIONS

U.S. Appl. No. 13/216,372, filed Aug. 24, 2011, Maeba, et al.
Extended European Search Report issued Dec. 1, 2011, in Patent Application No. 11180538.8.

* cited by examiner

*Primary Examiner* — H Gutman
(74) *Attorney, Agent, or Firm* — Oblon, Spivak, McClelland, Maier & Neustadt, L.L.P.

(57) ABSTRACT

A demountable pillar 16 is demountably mounted to an upper frame bottom plate 9 and a floor plate 10. A spacer 35 is detachably attached to the demountable pillar 16. The spacer 35 is detached in a state that an upper load is supported by a lifting bolt 39 to reduce the height of the demountable pillar 16, and the demountable pillar 16 is demounted in a state that the upper load is supported by the other pillars. A fuel tank 11 as a device is removed from between the upper frame bottom plate 9 and the floor plate 10 in this state.

8 Claims, 6 Drawing Sheets

DEVICE REMOVING/RE-INSERTING STRUCTURE, AND DEVICE REMOVING/RE-INSERTING METHOD FOR CONSTRUCTION MACHINE

BACKGROUND OF THE INVENTION

1. Field of the Invention

The present invention relates to a construction machine such as a hydraulic shovel, and, more specifically, to a device removing/re-inserting structure and a device removing/re-inserting method for removing/re-inserting a fuel tank in a device installation space, between a floor plate and a bottom plate of an upper frame of a swivel upper structure in a construction machine.

2. Description of the Background Art

Based on FIG. 10, the background art will be described by taking a small-size hydraulic shovel as an example. A similar structure is disclosed in JP 2008-240676A.

This hydraulic shovel comprises: a crawler-type base carrier 1; a swivel upper structure 2 mounted on the base carrier 1 rotatably about an axis vertical to the ground; and a working attachment A comprised of a boom 3, a non-illustrated arm, a non-illustrated bucket, and boom, arm and bucket cylinders (only the boom cylinder 4 is illustrated) and mounted to the swivel upper structure.

The swivel upper structure 2 has an upper frame 5 to which various devices such as an engine, a guard panel 6 covering the devices, and a cabin 8 provided with a cab seat 7, are mounted. The upper frame 5 has a bottom plate 9, and the devices are installed in a device installation space S defined between the upper frame bottom plate 9 and a floor plate 10 by a plurality of pillars, in an installation position for the cabin 8 (left-front region thereof).

The following description will be made on an assumption that a fuel tank 11 made of a synthetic resin is installed in the device installation space S which is provided with a pair of front and rear pillars each provided on right and left sides, i.e., four pillars in total (in FIG. 10, only left-front and left-rear pillars 12, 13 are illustrated). Each of the pillars has a lower end and an upper end fixedly attached, respectively, to the upper frame bottom plate 9 and the floor plate 10. The fuel tank 11 is installed removably with respect to the device installation space S in a horizontal (rightward-leftward) direction in order to perform internal washing or the like, and a left opening of the device installation space S serves as an insertion/removal port for the fuel tank.

As used in this specification, the terms "front", "rear", "right" and "left" mean directions as seen from an operator seated in the cab seat 7 within the cabin 8.

In the left-front and left-rear pillars 12, 13 located on the side of the insertion/removal port, the left-rear pillar 13 supporting a left-rear portion of the floor plate 10 is originally located in a tank removal/re-insertion path, so that it hinders an operation of removing and re-inserting the fuel tank 11.

Therefore, heretofore, as illustrated in FIG. 10, the left-rear pillar 13 has been mounted to be offset rearwardly with respect to the fuel tank 11 so as not to hinder the tank removal/re-insertion operation, and an upper end thereof for supporting the floor plate 10 has been formed in an inverted L shape overhanging frontwardly to a position suited to support the floor plate 10. As above, the left-rear pillar 13 is positionally constrained, and the upper end thereof has to be overhung, which brings disadvantages in terms of strength.

In view of the above circumferences, an object of the present invention is to provide a device removing/re-inserting structure and a device removing/re-inserting method for a construction machine, which enable to remove or re-insert a device in a device installation space, while disposing a pillar that obstructs a removal/re-insertion of the device at a position most suitable for functioning as the pillar and with a structure most advantageous in terms of the strength, in a condition that the device required to be removed/re-inserted in the device installation space from the outside is installed in the device installation space, between a lower member (in the above example, the upper frame bottom plate), and an upper member (in the above example, the floor plate), and at least one of the pillars defining the device installation space is the demountable pillar in the removal/re-insertion of the device.

SUMMARY OF THE INVENTION

In order to achieve the above object, the present invention provides a device removing/re-inserting structure for a construction machine configured such that an upper member (10) is mounted onto a lower member (9) as a load support member, while being supported by a plurality of pillars (14, 15, 16, 17) in a state that a device installation space (S) is formed between the lower and upper members (9, 10), and that a device is horizontally removed/re-inserted in the device installation space (S) from the outside through an insertion/removal port formed in a lateral portion of the device installation space (S). The structure includes the demountable pillar (16), of the plurality of pillars (14, 15, 16, 17), which is disposed on a removal/re-insertion path of the device in a state that the demountable pillar (16) obstructs a removal/re-insertion of the device. The demountable pillar (16) is demountably mounted to the lower and upper members (9, 10) in such a manner as to allow a removal/re-insertion of the device through the insertion/removal port.

According to the device removing/re-inserting structure of the invention, the demountable pillar which obstructs a removal/re-insertion of the device is demountably mounted to the lower and upper members, and the device is removed/re-inserted by demounting the demountable pillar from between the lower and upper members. This avoids interference of removal or re-insertion of the device by the demountable pillar.

In other words, it is possible to remove/re-insert the device, while disposing the demountable pillar at a position most suitable for functioning as the pillar and with a structure (configuration) most advantageous in terms of the strength.

These and other objects, features and advantages of the present invention will become more apparent upon reading the following detailed description along with the accompanying drawings.

DETAILED DESCRIPTIONS OF THE INVENTION

Figure 1:
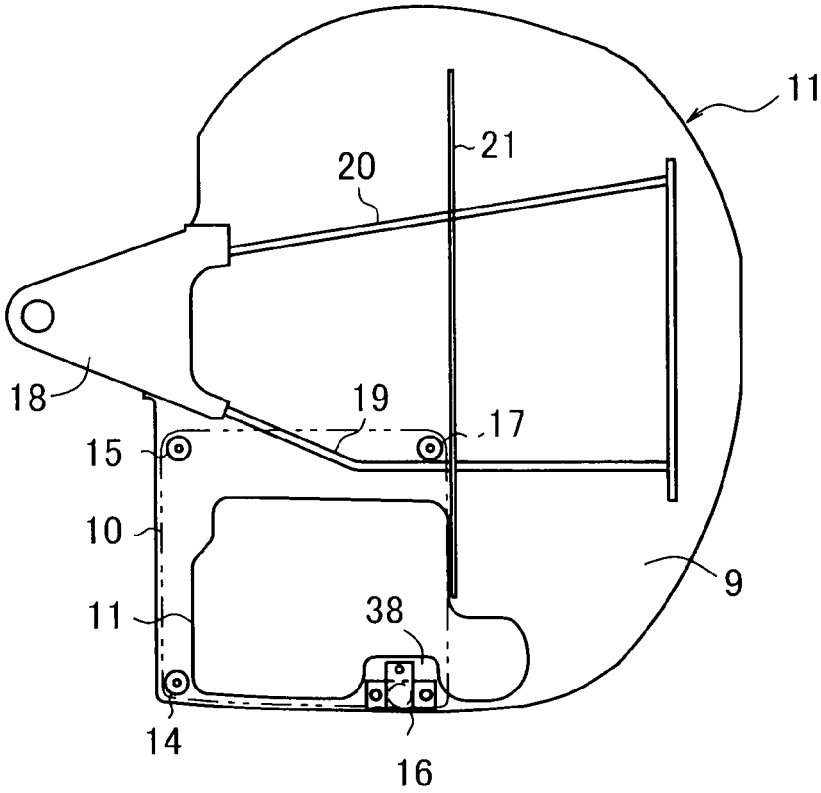
FIG. 1 is a schematic top plan view of an upper frame illustrating a first embodiment of the present invention.
Figure 2:
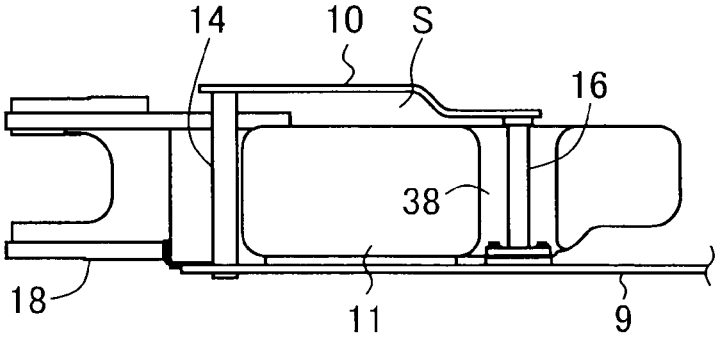
FIG. 2 is a side view of the upper frame.
Figure 3:
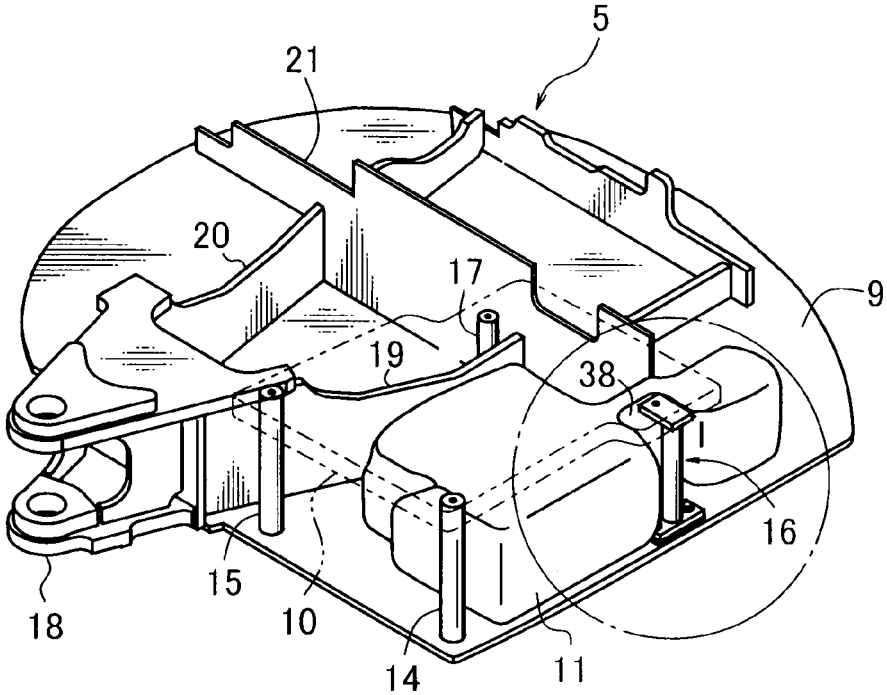
FIG. 3 is a perspective view of the upper frame.

The following embodiments will be described by taking a small-size hydraulic shovel as an example, as in the Description of Background Art, and on an assumption that a floor plate 10 as an upper member is supported above a bottom plate 9 of an upper frame 5 as a lower member, by a pair of front and rear pillars each provided on right and left sides, i.e., four pillars 14, 15, 16, 17 in total (right pillars 15, 17 are illustrated in FIGS. 1 and 3), and a fuel tank 11 made of a synthetic resin to serve as a device is installed in a device installation space S defined between the upper and lower frames (the reference code S is assigned only in FIGS. 2 and 6).

Figure 10:
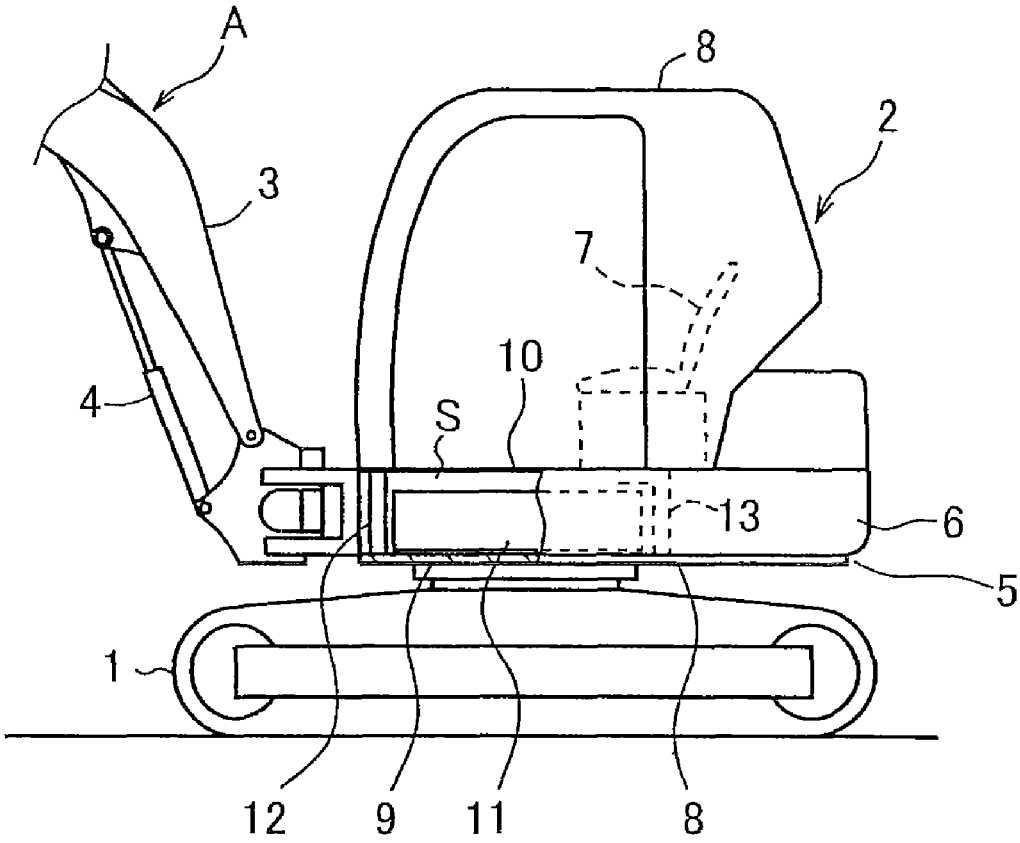
FIG. 10 PRIOR ART
FIG. 10 is a partially cut-away side view of a small-size hydraulic shovel to which the present invention is applicable.

In the embodiments of the present invention, the following points (i) to (iii) are the same as those in the conventional structure illustrated in FIG. 10.

(i) Various devices such as an engine, a guard panel covering the devices, and a cabin provided with a cab seat (all of which are not illustrated), are mounted to the upper frame 5 to form a swivel upper structure.

(ii) The pillars 14 to 17 are mounted on a left-front region of the upper frame bottom plate 9.

(iii) The fuel tank 11 is externally installed in a removable manner in a horizontal (rightward-leftward) direction using a left opening of the device installation space S as an insertion/removal port.

As illustrated in FIGS. 1 to 4, the upper frame bottom plate 9 has an attachment mounting bracket 18 provided at a front end thereof; two vertical plates 19, 20 provided on right and left sides in an intermediate region thereof in a rightward-leftward direction to extend in a frontward-rearward direction; and a partition wall 21 provided in an intermediate region thereof in the frontward-rearward direction to extend in the rightward-leftward direction while intersecting with the vertical plates 19, 20. Each of the vertical plates 19, 20 and the partition wall 21 is provided to stand vertically from the bottom plate 9, and the engine and devices associated therewith are installed in a rear region of the upper frame partitioned by the partition wall 21.

FIRST EMBODIMENT (SEE FIGS. 1 TO 7)

The fuel tank 11 is installed in the device installation space S in such a manner that most thereof is received in a left-front region of the upper frame compartmented by the left vertical plate 19 and the partition wall 21, and only a rear end thereof is located rearward of the partition wall 21.

The fuel tank 11 is fixed within the space S by a tank fixing member, and an oil filler pipe having a filler opening at a distal end thereof is attached to an upper surface of a rear end of the fuel tank. These components are not illustrated, because they are not directly relevant to the present invention.

In the left-front and left-rear pillars 14, 16 installed on the side of the insertion/removal port for the fuel tank 11, the left-rear pillar 16 supporting a left-rear portion of the floor plate 10 is located in a tank removal/re-insertion path, so that it hinders an operation of removing and re-inserting the fuel tank 11. Therefore, the left-rear pillar 16 is formed as a demountable pillar, and demountably mounted between the floor plate 10 and the upper frame 9. The demountable pillar will be specifically described below.

Figure 4:
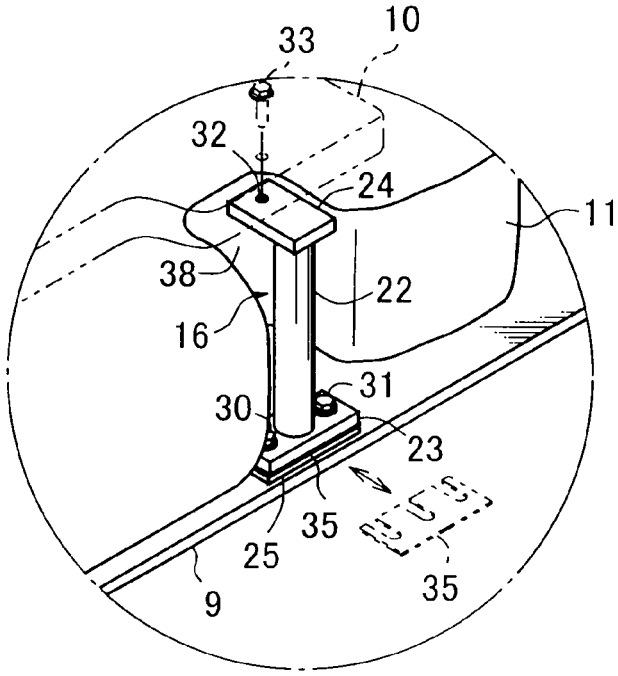
FIG. 4 is an enlarged view of the encircled area in FIG. 3.
Figure 5:
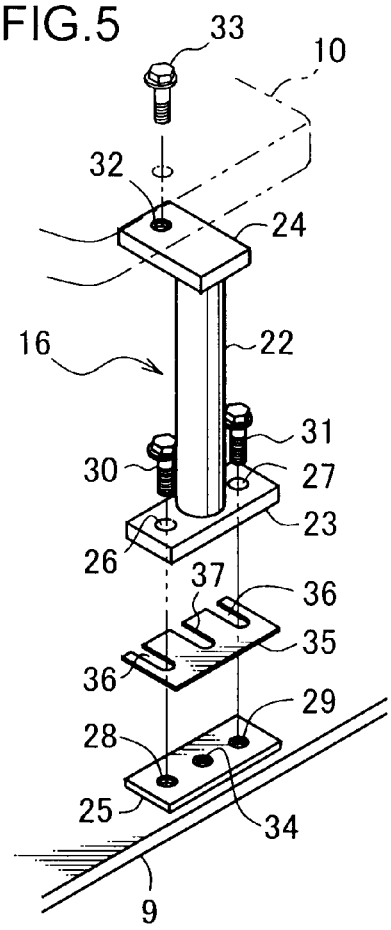
FIG. 5 is an exploded perspective view further enlargedly illustrating a left-rear pillar as a demountable pillar.
Figure 6:
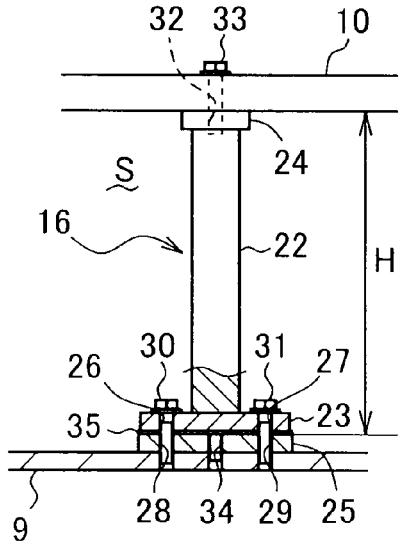
FIG. 6 is a partially sectional side view illustrating a mounted state of the demountable pillar.

As specifically illustrated in FIGS. 4 to 6, the left-rear pillar 16 comprises: a column-shaped pillar body 22; a rectangular plate-shaped base 23 elongated in the frontward-rearward direction and attached to a lower end of the pillar body 22 in a horizontal posture; and a rectangular plate-shaped floor-plate receiving portion 24 elongated in the rightward-leftward direction and attached to an upper end of the pillar body 22 in a horizontal posture. The base 23 and the floor-plate receiving portion 24 are demountably mounted to the upper plate bottom plate 9 and the floor plate 10, respectively.

More specifically, as base mounting unit, two bolt insertion holes 26, 27 are provided in the base 23 on both sides of the pillar body 22 in the frontward-rearward direction, and two screw holes 28, 29 are provided in the upper frame bottom plate 9 and a washer plate 25 fixedly attached onto an upper surface of the bottom plate 9. Two lower mounting bolts 30, 31 are screwed, respectively, in the screw holes 28, 29 through the bolt insertion holes 26, 27, so that the base 23 is mounted to the upper frame bottom plate 9.

On the other hand, as floor-plate receiving portion mounting unit, a screw hole 32 is provided in the floor-plate receiving portion 24. An upper mounting bolt 33 (see FIGS. 4 to 7) is screwed in the screw hole 32 from thereabove through the floor plate 10, so that the floor-plate receiving portion is mounted to the floor plate 10.

Further, a lifting screw hole 34 (see FIGS. 5 and 6) are provided in a central portion of the washer plate 25 to penetrate through the washer plate 25 and the upper frame bottom plate 9, and an aftermentioned lifting bolt is adapted to be screwed in the screw hole 34 from below the bottom plate. The lifting screw hole 34 and the aftermentioned lifting bolt or the like make up screw unit.

In this structure, a spacer 35 additionally serving as a height adjustment shim is inserted between the base 23 and the washer plate 25

The spacer 35 has two clearance grooves 36, 36 each provided on a respective one of front and rear sides thereof to have a clearance with respect to a corresponding one of the lower mounting bolts 30, 31, and a clearance groove 37 provided in a central portion thereof to have a clearance with respect to the lifting bolt. Each of the clearance grooves is formed as a cutout extending in the rightward-leftward direction to have an open right end. The clearance grooves 36, 26, 37 allow the spacer 35 to be detached leftwardly and horizontally and then re-inserted, under a no-load condition.

The left-rear pillar 16 is set such that a total dimension H (see FIG. 6) including the spacer 35 becomes equal to a distance between the floor plate 10 and an upper surface of the washer plate 25 on the upper frame bottom plate 9.

Thus, in a state after the spacer 35 is detached, a height dimension of the left-rear pillar 16 itself becomes less than the above distance (distance between the washer plate 25 and the floor plate 10), so that, in this state and under a condition that the upper load is released, the pillar 16 becomes removable and re-insertable with respect to a space between the upper frame bottom plate 9 and the floor plate 10 (washer plate 25) in the horizontal direction.

Further, the fuel tank 11 is formed with a concave groove 38 (see FIGS. 1 to 4) having a clearance with respect to the left-rear pillar 16 and extending in an upward-downward direction, in a region of a left surface thereof facing the pillar 16.

This makes it possible to maximally expand a lateral surface of the fuel tank 11 outwardly (toward the insertion/removal port) so as to increase a capacity of the fuel tank, utilizing that the left-rear pillar 16 is demountably mounted. In addition, the concave groove 38 can serve as a rib to bring out a reinforcing effect so as to increase strength of the lateral surface of the fuel tank.

With reference to FIG. 7A to 7H, a process (operation) of removal/re-insertion of the fuel tank 11 including demounting/re-mounting the left-rear pillar 16 will be described below. For avoiding complexity in illustration, only minimum reference numerals or codes are assigned in FIGS. 7A to 7H, and other figures will be referred to according to need.

Figure 7A:
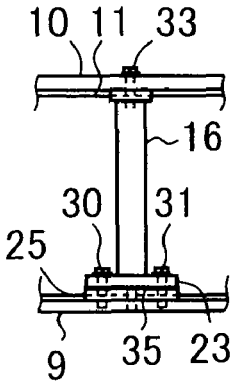
FIGS. 7A to 7H illustrate a process of demounting the demountable pillar.

FIG. 7A illustrates a state that the fuel tank 11 is installed and the left-rear pillar 16 is mounted. In this state, the left-rear pillar 16 is located in the tank removal/re-insertion path, and the upper load is supported by the upper frame bottom plate 9 through the left-rear pillar 16 and the remaining pillars 14, 15, 17. This state of the left-rear pillar 16 is called as a "load support state".

Figure 7B:
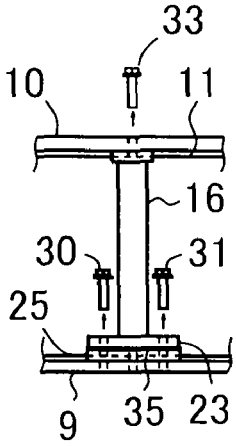

Then, as illustrated in FIG. 7B, the upper mounting bolt 33 and the lower mounting bolts 30, 31 are detached. In this state, the upper load is still being applied to the pillar 16.

Figure 7C:
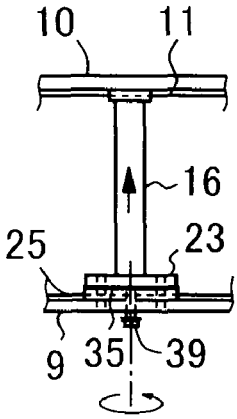

Then, as illustrated in FIG. 7C, a lifting bolt 39 (one of the detached mounting bolts 30, 31, 33 may be diverted thereto, or a dedicated bolt may be used) is screwed in (screwed forwardly) from below the bottom plate, and further screwed in while keeping a distal end of the lifting bolt 39 in contact with a lower surface of the base 23. In this manner, the pillar 16 is lifted up together with the floor plate 10 while leaving the spacer 35 in its initial position, to establish the state illustrated in FIG. 7D. L in FIG. 7D indicated a lift amount of the upper member (floor plate 9) by the lifting bolt 39 during the above operation.

In order to facilitate the screw-in operation using the lifting bolt 39, a lifting bolt with a handle may be used.

Figure 7D:
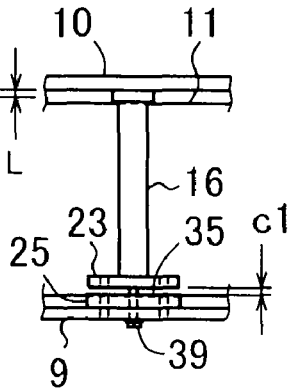

In the state illustrated in FIG. 7D, each of the floor plate 9 and the pillar 16 is lifted up by the dimension L, so that a spacer detachment/re-attachment gap c1 is formed between the base 23 and the spacer 35, and the upper load is supported by the lifting bolt 39 in place of the spacer 35. This means that the spacer 35 is placed in a free state (a no-load state) without receiving any load from thereabove.

Figure 7E:
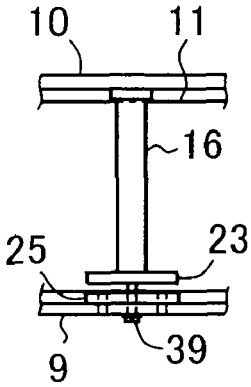
Figure 7F:
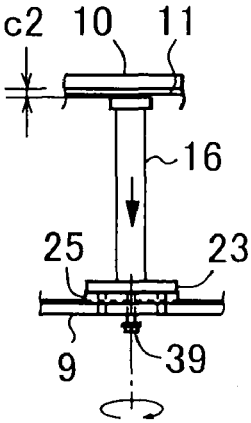
Figure 7G:
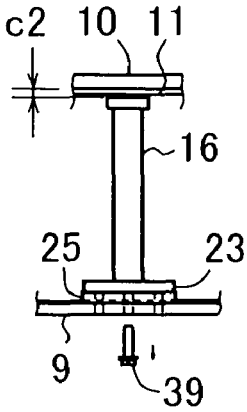

Thus, as illustrated in FIG. 7E, the spacer 35 is extracted leftwardly (as seen from an operator seated in the cab seat) and horizontally, and then the lifting bolt 39 is loosened (screwed backwardly) and detached as illustrated in FIGS. 7F and 7G.

Through this operation, each of the left-rear pillar 16 and the floor plate 10 is lowered, and, then after the upper load including the floor plate 10 is supported by the remaining three pillars 14, 15, 17, only the pillar 16 is continuously lowered (the lower surface of the base 23 of the pillar 16 comes into contact with the upper surface of the washer plate 25 without interposing the spacer 35 therebetween).

Figure 7H:
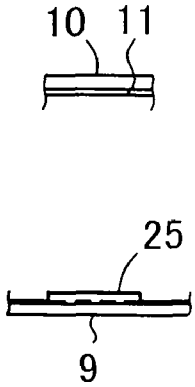
Figure 8:
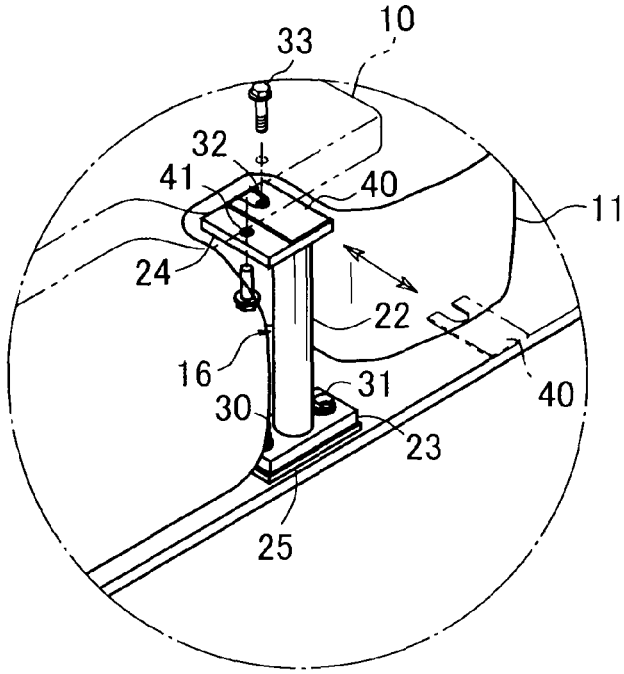
FIG. 8 is a view illustrating a second embodiment of the present invention, which corresponds to FIG. 4.

In the state illustrated in FIG. 7G, a gap c2 equivalent to a thickness of the spacer 35 is formed between the floor plate 10 and the upper end of the left-rear pillar 16, so that the pillar 16 is placed in a state that the upper load is released (a no-load state). Thus, as illustrated in FIG. 7H, the pillar 16 can be demounted toward the insertion/removal port (leftwardly as seen from an operator seated in the cab seat).

In this state, the insertion/removal port is fully opened, so that the fuel tank 11 can be removed leftwardly to perform maintenance such as cleaning.

Further, after the maintenance, the fuel tank 11 is re-installed. Then, the left-rear pillar 16 can be re-mounted in its original position according to a process (operation) which is the inverse of that in FIGS. 7A to 7H.

As above, in this fuel tank removal/re-insertion method, the left-rear pillar 16 as the demountable pillar which may hinder a tank removal/re-insertion can be demountably mounted to the upper frame bottom plate 9 and the floor plate 10, and the left-rear pillar 16 can be demounted from between the upper frame bottom plate 9 and the floor plate 10, so that the fuel tank 11 is removed/re-inserted in a state that the upper load is supported by the remaining pillars 14, 15, 17. This prevents the left-rear pillar 16 from being a hindrance against a device removal/re-insertion.

Thus, it is possible to remove/re-insert the fuel tank 11, while positioning the left-rear pillar 16 at a position most suitable for functioning as a pillar, and with a structure (configuration) most advantageous in terms of the strength.

In this case, it is only necessary to add the spacer 35 which increases the total height dimension of the pillar, and the screw unit (the screw hole 34 and the lifting bolt 39) to the pillar 16. In addition, the spacer detachment/attachment gap c1 and the pillar demounting/re-mounting gap c2 are formed, so that the left-rear pillar 16 is demounted in a contracted state where the spacer 35 is detached, and the left-rear pillar 16 is re-mounted according to the inverse process (operation). Thus, the pillar demounting/re-mounting structure can be simplified with addition of the spacer 35 and the screw unit.

The left-rear pillar 16 is switchable by the screw unit between a load support state where a load on the upper side of the left-rear pillar 16 is supported by the left-rear pillar 16, and a no-load state where the load is not supported by the left-rear pillar 16; and the screw unit constitutes a switching unit which switches the left-rear pillar 16 between a load support state, and a no support (no-load) state.

In addition, the spacer 35 can also serve as a height adjusting shim, and the lifting bolt 39 can be obtained, for example, by diverting one of the mounting bolts 30, 31, 33 for the pillar 16, so that it becomes possible to reduce the number of parts and keep cost low.

Further, the spacer 35 is provided with the clearance groove 37 having a clearance with respect to the lifting bolt 39 (a groove having one end in a closed state, and a width greater than a diameter of the bolt 39), so that the spacer 35 can be detached and re-attached while maintaining the screwed-in state of the lifting bolt 39. Therefore, as compared to cases where the spacer 35 is divided to avoid interference with the lifting bolt 39, the detachment/re-attachment operation for the spacer 35 becomes easier.

SECOND EMBODIMENT (SEE FIGS. 8, 9A AND 9B)

A second embodiment will be described below with a focus on a difference from the first embodiment.

In the second embodiment, a spacer 40 is adapted to be inserted between the floor plate 10 and a floor-plate receiving portion 24 of a left-rear pillar 16, in a demountable manner, and the spacer 40 is detached/re-attached to demount/re-mount the left-rear pillar 16.

The floor-plate receiving portion 24 is formed in a rectangular plate shape protruding rightwardly and frontwardly from a pillar body 22, and provided with a screw hole 32 for an upper mounting bolt 33, and a screw hole 41 for a lifting bolt 39, respectively, in a rightwardly-protruding region and a frontwardly-protruding region thereof.

In the illustrated embodiment, the spacer 40 is formed in a horseshoe-like shape (U shape) provided with only a clearance groove having a clearance with respect to the upper mounting bolt 33. Alternatively, the spacer 40 may be formed in a shape having a large width and additionally provided with a clearance groove having a clearance with respect to the lifting bolt 39.

Figure 9A:
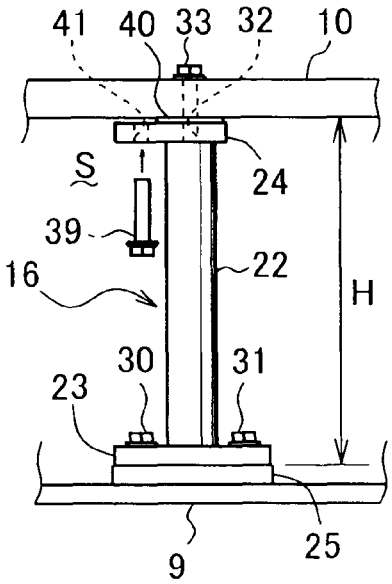
FIGS. 9A and 9B illustrate, respectively, a mounted state of a demountable pillar, and a state during a course of demounting the demountable pillar, in the second embodiment.
Figure 9B:
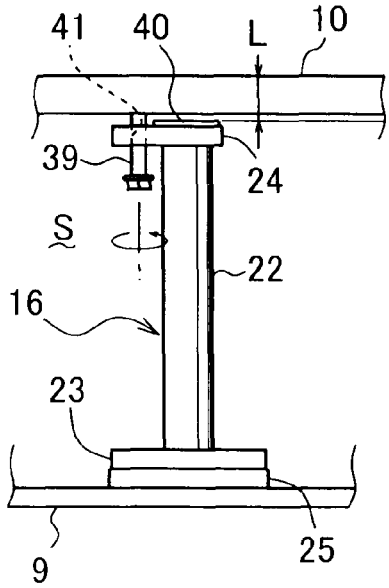

FIG. 9A illustrates a mounted state of the left-rear pillar 16. In an operation of demounting the pillar 16 to remove/re-insert a fuel tank (not shown), the lower and upper mounting bolts 30, 31, 33 are detached, and the lifting bolt 39 is screwed in the lifting-bolt screw hole 41 from therebelow to lift up the floor plate as illustrated in FIG. 9B (L indicates a lift amount).

In this state, the spacer 40 is detached, and the upper load is supported by the remaining pillars 14, 15, 17 by loosening the lifting bolt 39 to form a gap (the gap c2 shown in FIG. 7) equivalent to a thickness of the spacer 40, and the left-rear pillar 16 is demounted for removal/re-insertion of the fuel tank. The pillar 16 is re-mounted according to the inverse process (operation).

Basically, the second embodiment can obtain the same effects as those in the first embodiment.

Modifications (1) The embodiments are configured such that the total height dimension of the left-rear pillar 16 and the spacer 35 is made variable by detachment/re-attachment of the spacer 35. Alternatively, a left-rear pillar 16 may be formed by connecting upper and lower divided pillar portions by a screw joint, and the pillar itself may be expanded or contracted by rotating the divided pillar portions relative to each other.

In this modification, however, since the relative motion is required between the upper and lower divided pillar portions, the operation thereof could be more cumbersome, yet with the fewer process is required.

(2) Although the above embodiments have been described based on an example where the fuel tank 11 is installed between the upper frame bottom plate 9 and the floor plate 10, the present invention may also be implemented in cases where a battery or other device is installed therebetween.

(3) Further, the present invention is not limited to a case where the structure is provided between the upper frame bottom plate 9 and the floor plate 10, but may be widely used in a condition where an upper member is supported above a lower member by a plurality of pillars, wherein it is necessary to appropriately demount at least one of the pillars to remove/re-insert a device in between the upper frame bottom plate 9 and the floor plate 10.

(4) It is understood that the present invention may be applied to any type of construction machine other than a hydraulic shovel.

As described above, the present invention provides a device removing/re-inserting structure for a construction machine configured such that an upper member (10) is mounted above a lower member (9) as a load support member by a plurality of pillars (14, 15, 16, 17) in a state that a device installation space (S) is formed between the lower and upper members (9, 10), and that a device is horizontally removed/re-inserted in the device installation space (S) from the outside through an insertion/removal port formed in a lateral portion of the device installation space (S). The structure includes the demountable pillar (16), of the plurality of pillars (14, 15, 16, 17), which is disposed on a removal/re-insertion path of the device in a state that the demountable pillar (16) obstructs a removal/re-insertion of the device. The demountable pillar (16) is demountably mounted to the lower and upper members (9, 10) in such a manner as to allow a removal/re-insertion of the device through the insertion/removal port.

According to the device removing/re-inserting structure of the invention, the demountable pillar which obstructs a removal/re-insertion of the device is demountably mounted to the lower and upper members, and the device is removed/re-inserted by demounting the demountable pillar from between the lower and upper members. This avoids interference of removal/re-insertion of the device by the demountable pillar.

In other words, it is possible to remove/re-insert the device, while disposing the demountable pillar at a position most suitable for functioning as the pillar and with a structure (configuration) most advantageous in terms of the strength.

Preferably, the device removing/re-inserting structure may further include a switching unit which switches the demountable pillar (16) between a load support state where a total height dimension of the demountable pillar (16) including other members (35, 25) is equal to the interval between the lower and upper members (9, 10) to support a load, and a no-load state where the total height dimension is smaller than the interval by demounting the other members (35, 25), wherein the demountable pillar (16) is detached from between the lower and upper members (9, 10) in the no-load state to allow the removal/re-insertion of the device.

In the above construction, the total height dimension of the demountable pillar and the spacer is adjustable by the switching unit, and the demountable pillar is switchable between a load support state where a spacer (one of the other members) is interposed, and a no-load state where the spacer is detached to demount/re-mount the demountable pillar from/in between the lower and upper members in a no-load state that the spacer is detached. In this construction, the demountable pillar is re-mounted after a removal/re-insertion of the device in the no-load state. Thus, switching the demountable pillar between a load support state and a no-load state enables to easily and safely remove/re-insert the device without damaging the demountable pillar and a structural member around the demountable pillar.

In the device removing/re-inserting structure, preferably, the other members (25, 35) may include a spacer (35), the switching unit may be provided with a screw unit which is adapted to raise or lower a member on the upper side of the spacer (35; 40) by a screw thrust force of the screw unit, and a spacer detachment/re-attachment gap (c1) may be formed by the screw unit to attach or detach the spacer, and the spacer (35; 40) is detached to form a pillar demounting/re-mounting gap (c2) between the upper member (10) and the lower member (9) so as to bring the demountable pillar (16) to the no-load state for demounting/re-mounting the demountable pillar (16).

In the above construction, the switching unit is provided with the screw unit which is adapted to raise or lower a member on the upper side of the spacer (in the first embodiment, the pillar and the upper member; and in the second embodiment, the upper member) by a screw thrust force of the screw unit to adjust the total height dimension of the demountable pillar and the spacer by the screw unit. Further, the demountable pillar is switchable between a load support state where the spacer (one of the other members) is interposed, and a no-load state where the spacer is detached to demount the demountable pillar from between the lower and upper members in a no-load state where the spacer is detached. Then, the demountable pillar is re-mounted after a removal/re-insertion of the device in the no-load state. Thus, switching the demountable pillar between a load support state and a no-load state enables to easily and safely remove/re-insert the device without damaging the demountable pillar and a structural member around the demountable pillar.

Another aspect of the invention is directed to a device removing/re-inserting method for a construction machine configured such that an upper member (10) is mounted above a lower member (9) as a load support member by a plurality of pillars (14, 15, 16, 17) in a state that a device installation space is formed between the lower and upper members (9, 10), and that a device is horizontally removed/re-inserted in the device installation space from the outside through an insertion/removal port formed in a lateral portion of the device installation space. The method includes a first step of demountably mounting the demountable pillar (16), of the plurality of pillars (14, 15, 16, 17), which is disposed on a removal/re-insertion path of the device in a state that the demountable pillar (16) obstructs a removal/re-insertion of the device; a second step of demounting the demountable pillar (16) from between the lower and upper members (9, 10); and a third step of removing/re-inserting the device in the device installation space in a state that an upper load including the upper member (10) is supported by the other pillars (14, 15, 17).

According to the device removing/re-inserting method of the invention, the demountable pillar which obstructs a removal/re-insertion of the device is demountably mounted to the lower and upper members, and the device is removed/re-inserted by demounting the demountable pillar from between the lower and upper members. This avoids interference of removal/re-insertion of the device by the demountable pillar.

In other words, it is possible to remove/re-insert the device, while disposing the demountable pillar at a position most suitable for functioning as the pillar and with a structure (configuration) most advantageous in terms of the strength.

Preferably, the demountable pillar (16) may be configured to be switchable between a load support state where a total height dimension of the demountable pillar (16) including other members (25, 35) is equal to an interval between the lower and upper members to support a load, and a no-load state where the total height dimension is smaller than the interval by demounting the other members, and the demountable pillar (16) may be demounted from between the lower and upper members (9, 10) in the no-load state, and re-mounted after the removal/re-insertion of the device.

In the above construction, it is possible to switch the demountable pillar between a load support state where the spacer (one of the other members) is interposed, and a no-load state where the spacer is detached by adjusting the total height dimension of the demountable pillar and the spacer. This enables to demountably mount the demountable pillar between the lower and upper members in a no-load state where the spacer is detached. Then, the demountable pillar is re-mounted after a removal/re-insertion of the device in the no-load state. Thus, switching the demountable pillar between a load support state and a no-load state enables to easily and safely remove/re-insert the device without damaging the demountable pillar and a structural member around the demountable pillar.

Preferably, the construction machine may be provided with a spacer (35) which increases the total height dimension of the demountable pillar (16) to bring the demountable pillar (16) to the load support state, and a screw unit which is adapted to raise or lower a member (in the first embodiment, the pillar and the upper member, and in the second embodiment, the upper member) on the upper side of the spacer by a screw thrust force of the screw unit, and in the second step, a spacer detachment/re-attachment gap may be formed by the screw unit to detach/re-attach the spacer (35), and the spacer (35) may be detached to form a pillar demounting/re-mounting gap (c2) between the upper member (10) and the lower member (9) so as to bring the demountable pillar (16) to the no-load state for demounting/re-mounting the demountable pillar (16).

In the above construction, the spacer which is adapted to increase the total height dimension of the demountable pillar, and the screw unit are provided. The spacer detachment/re-attachment gap and the pillar demounting/re-mounting gap are formed by the screw unit. The demountable pillar is demounted in a no-load state where the spacer is detached. The demountable pillar is re-mounted according to the inverse process (operation). This simplifies the structure for demounting/re-mounting the demountable pillar, and reduces the cost for the pillar demounting/re-mounting structure.

Preferably, the construction machine may be provided with a spacer (35; 40) which is disposed between the upper member (10) and the lower member (9), and has a predetermined thickness on an upper side or a lower side of the demountable pillar (16), and a screw unit which raises a member on the upper side of the spacer by a screw thrust force of the screw unit, and the second step may include a sub step of raising the member on the upper side of the spacer until a spacer detachment/re-attachment gap (c2) is formed by the screw unit, a sub step of detaching the spacer (35; 40) upon formation of the spacer detachment/re-attachment gap (c2), a sub step of releasing the raised state of the upper member (10) by the screw unit to bring the demountable pillar (16) to the no-load state, and a sub step of demounting/re-mounting the demountable pillar (16) from between the upper member (10) and the lower member (9).

In the above construction, the switching unit is provided with the screw unit which is adapted to raise or lower the member (in the first embodiment, the pillar and the upper member; and in the second embodiment, the upper member) on the upper side of the spacer by a screw thrust force of the screw unit to adjust the total height dimension of the demountable pillar and the spacer by the screw unit. Further, a spacer detachment/re-attachment gap necessary for detaching the spacer is formed from a load support state where the spacer (one of the other members) is interposed by raising the upper member by the screw unit, and there is formed a gap between the upper end of the demountable pillar and the upper member (the demountable pillar in a no-load state) even in a state where the raised state of the upper member by the screw unit is released after detachment of the spacer. This enables to demount the demountable pillar from between the lower and upper members. It is possible to re-mount the demountable pillar after removal/re-insertion of the device in the no-load state.

Preferably, a fuel tank (11) as the device may be formed with a vertically extending recess groove (38) in a lateral portion thereof toward the insertion/removal port, and the demountable pillar may be demountably mounted to the lower and upper members in a state that the demountable pillar is received in the recess groove.

In the above construction, in the case where the fuel tank is installed as the device, the vertically extending recess groove is formed in the lateral portion of the fuel tank toward the insertion/removal port, utilizing an advantage that the demountable pillar is demountably mounted; and the demountable pillar is re-mounted between the lower and upper members in a state that the demountable pillar is received in the recess groove. This enables to maximally expand the lateral portion of the fuel tank outward (in the direction toward the insertion/removal port), thereby increasing the tank capacity. Further, the portion of the fuel tank where the recess groove is formed serves as a reinforcing rib. This increases the strength of the lateral portion of the fuel tank.

This application is based on Japanese Patent Application No. 2010-205689 filed in Japan Patent Office on Sep. 14, 2010, the contents of which a re hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A structure for a construction machine, comprising:

a lower member as a load support member;

an upper member mounted above the lower support member; and a plurality of pillars supporting the upper member in a state that a device installation space is formed between the lower and upper members, the device installation space having an insertion and removal port formed in a lateral portion of the device installation space to allow the device to be horizontally removed and reinserted in the device installation space from the outside through the insertion and removal, wherein:

the plurality of pillars include a demountable pillar, the demountable pillar being disposed on the insertion and removal port in a state that the demountable pillar obstructs the removal and reinsertion a of the device, the demountable pillar being demountably mounted to the lower and upper members in such a manner as to allow a removal and reinsertion of the device through the insertion and removal port.

2. The structure for a construction machine as defined in claim 1, further comprising:

a switching unit which switches the demountable pillar between a load support state where a total height dimension of the demountable pillar and other members disposed between the demountable pillar and the lower member or the upper member is equal to an interval between the lower and upper members to support a load, and a no-load state where the total height dimension is smaller than the interval by demounting the other members, wherein the demountable pillar is demounted from between the lower and upper members in the no-load state to allow the removal and reinsertion of the device.

3. The structure for a construction machine as defined in claim 2, wherein the other members include a spacer, the switching unit is provided with a screw unit which is adapted to raise or lower the upper member on an upper side of the spacer by a screw thrust force of the screw unit, and a spacer detachment and reattachment gap is formed by the screw unit to detach and reattach the spacer, and the spacer is detached to form a pillar demounting and remounting gap between the upper member and the lower member so as to bring the demountable pillar to the no-load state for demounting and remounting the demountable pillar.

4. A device removing and reinserting method for a construction machine, the construction machine comprising:

a lower member as a load support member;

an upper member mounted above the lower support member; and a plurality of pillars supporting the upper member in a state that a device installation space is formed between the lower and upper members, the device installation space having an insertion and removal port formed in a lateral portion of the device installation space to allow the device to be horizontally removed and reinserted in the device installation space from the outside through the insertion and removal port, wherein:

the plurality of pillars includes a demountable pillar and remaining pillars other than the demountable pillar, the demountable pillar being disposed on the insertion and removal port in a state that the demountable pillar obstructs the removal and reinsertion of the device, the method comprising the steps of:

a first step of demountably mounting the demountable pillar;

a second step of demounting the demountable pillar from between the lower and upper members; and a third step of removing and reinserting the device in the device installation space in a state that an upper load including the upper member is supported by the remaining pillars.

5. The device removing and reinserting method as defined in claim 4, wherein the demountable pillar is configured to be switchable between a load support state where a total height dimension of the demountable pillar and other members disposed between the demountable pillar and the lower member or the upper member is equal to an interval between the lower and upper members to support a load, and a no-load state where the total height dimension is smaller than the interval by demounting the other members, and the demountable pillar is demounted from between the lower and upper members in the no-load state, and is re-mounted after the removal and reinsertion of the device.

6. The device removing and reinserting method as defined in claim 5, wherein the construction machine is provided with a spacer which increases the total height dimension of the demountable pillar and the spacer to bring the demountable pillar to the load support state, and a screw unit which is adapted to raise or lower the upper member on an upper side of the spacer by a screw thrust force of the screw unit, and in the second step, a spacer detachment and reattachment gap is formed by the screw unit to detach and reattach the spacer, and the spacer is detached to form a pillar demounting and remounting gap between the upper member and the lower member so as to bring the demountable pillar to the no-load state for demounting and remounting the demountable pillar.

7. The device removing and reinserting method as defined in claim 5, wherein the construction machine is provided with a spacer which is disposed between the upper member and the lower member, and has a predetermined thickness on an upper side or a lower side of the demountable pillar, and a screw unit which raises the upper member on an upper side of the spacer by a screw thrust force of the screw unit, and the second step includes a sub step of raising the upper member on the upper side of the spacer until a spacer detachment and reattachment gap is formed by the screw unit, a sub step of detaching the spacer upon formation of the spacer detachment and reattachment gap, a sub step of releasing a raised state of the upper member by the screw unit to bring the demountable pillar to the no-load state, and a sub step of demounting and remounting the demountable pillar from and in between the upper member and the lower member.

8. The device removing and reinserting method as defined in claim 4, wherein a fuel tank as the device is formed with a vertically extending recess groove in a lateral portion thereof toward the insertion and removal port, and the demountable pillar is demountably mounted to the lower and upper members in a state that the demountable pillar is received in the recess groove.

* * * * *